US005473523A

United States Patent [19]

Von Fange

[11] Patent Number: 5,473,523

[45] Date of Patent: Dec. 5, 1995

[54] METHOD AND MEANS FOR SIMULTANEOUSLY CHANGING THE BEAM ANGLE OF ALL OF THE LIGHT SOURCES IN AN ARRAY OF LIGHT SOURCES

[76] Inventor: Eric Von Fange, P.O. Box 767, Fort Mill, S.C. 29716

[21] Appl. No.: 257,005

[22] Filed: Jun. 8, 1994

[51] Int. Cl.[6] ..... F21V 19/02

[52] U.S. Cl. ..... 362/232; 362/240; 362/241; 362/250; 362/285; 362/287; 362/427; 362/428

[58] Field of Search ..... 362/233, 235, 362/237, 238, 239, 289, 240, 241, 282, 283, 285, 287, 250, 294, 373, 346, 297, 298, 232, 236, 345, 427, 428, 247, 304, 305

[56] References Cited

U.S. PATENT DOCUMENTS

| | | | |
|---|---|---|---|
| 4,061,912 | 12/1977 | Levasseur | 362/287 |
| 4,066,887 | 1/1978 | Levis | 362/346 X |
| 4,254,453 | 3/1981 | Mouyard et al. | 362/238 X |
| 4,316,237 | 2/1982 | Yamada et al. | 362/282 X |
| 4,409,646 | 10/1983 | Baliozian | 362/346 X |
| 4,423,469 | 12/1983 | Zerlaut et al. | 362/287 X |
| 4,631,643 | 12/1986 | Köster | 362/282 X |
| 4,638,414 | 1/1987 | de Vos et al. | 362/282 X |
| 4,729,065 | 3/1988 | Bahnemann et al. | 362/232 X |

*Primary Examiner*—Ira S. Lazarus
*Assistant Examiner*—Thomas M. Sember
*Attorney, Agent, or Firm*—Clifton Ted Hunt

[57] ABSTRACT

This invention relates to a method and apparatus for simultaneously changing the beam angle of all of the lamps in an array of lamps between a spot beam and a flood beam by simultaneously moving all of the lamps in the array forwardly and rearwardly relative to a carved portion of their respective reflectors.

2 Claims, 5 Drawing Sheets

FWD.
RWD.

METHOD AND MEANS FOR SIMULTANEOUSLY CHANGING THE BEAM ANGLE OF ALL OF THE LIGHT SOURCES IN AN ARRAY OF LIGHT SOURCES

FIELD OF THE INVENTION

This invention relates to a method and apparatus for simultaneously changing the beam angle of all of the lamps in an array of lamps between a spot beam and a flood beam by simultaneously moving all of the lamps in the array forwardly and rearwardly relative to their respective reflectors.

BACKGROUND OF THE INVENTION

U.S. Pat. No. 4,729,077 to Gordin shows a luminaire assembly for high power, high intensity lighting applications, comprising a luminaire fixture to which are operatively mounted a reflector having an innermost center portion and an outermost peripheral portion, and a single high power, high intensity, lamp to which is operatively supplied electrical power to produce a light beam. An adjustable lamp positioning means is mounted between the luminaire fixture and the lamp. The light positioning means is power operated to vary the width of the light beam (beam angle) produced by the lamp between a narrow or spot beam and a wide or flood beam, according to choice, by moving the lamp relative to its reflector. The term "beam angle" is known in the art to mean the included angle between those points on opposite sides of the beam axis at which the luminous intensity from a light source is 50% of maximum.

U.S. Pat. No. 4,675,794 to Fink shows a high intensity lamp fixture with a mounting mechanism within the lamp fixture that allows movement of the light source within the fixture relative to a reflector surrounding the light source to allow adjustment of the beam of light emanating from the light source. Fink's apparatus includes a housing surrounding the light source, a generally parabolic reflector, and an adjustable lamp socket support mechanism for positioning the lamp socket relative to the parabolic reflector. Fink's preferred adjustment mechanism is a manually operable screw mechanism for adjusting the position of a single support bracket and lamp socket to a desired position relative to the reflector so that a single beam of light from a single light source or lamp in the one socket may be controlled between a wide or flood beam and a narrow or spot beam.

U.S. Pat. No. 4,967,325 to Shiau shows a flashlight comprising a bead assembly rotatably engaged with a barrel. A lamp base is fixed inside the head assembly. When the head assembly is rotated relative to the barrel, a flashlight bulb fixed to the lamp base moves axially away from or toward a lens attached to the head assembly, thus varying the focusing distance of the bulb and providing a spot beam or flood beam, as desired.

U.S. Pat. No. 4,386,391 to Gulliksen shows a luminaire apparatus with multiple light sources, including method and means for providing individual adjustment of the beam angle for each energized light source. The individual focus adjustment for each energized light source is accomplished by individually moving a selected light source along a focal axis of the luminaire apparatus to provide a spot beam or flood beam, as desired.

The prior art known to applicant shows it old to change the beam angle of a single light source by moving the light source relative to the reflector surrounding the light source or lamp but, to applicant's knowledge, nothing in the prior art suggests any method or means for simultaneously changing the beam angle of all of the light sources in an array of multiple light sources.

SUMMARY OF THE INVENTION

In practicing the present invention, the changing of the beam of a light beam from an array of multiple lamps is accomplished in the same manner as the focus of a single lamp is changed in the prior art, namely, by moving the light sources or lamps relative to their reflectors. The novelty of the present invention is the method of simultaneously changing the beam angle of all of the light sources in an array of multiple light sources, and the means for simultaneously changing the beam angle of all of the light sources in an array.

According to the present invention, a plurality of light sources or lamps (an array) is mounted on a frame and a platen within a detachable housing. Each of the lamps comprises two sockets, a bulb, and a curved reflector. All of the reflectors are mounted on the frame and all of the sockets and bulbs are mounted on the platen. Manually operable screws, connected by a chain and sprockets, connect the platen and frame and may be rotated in one direction to move the sockets and bulbs on the platen forwardly within their respective reflectors secured to the frame. Rotated in the opposite direction, the screws move the sockets and bulbs rearwardly relative to their respective curved reflectors, thereby simultaneously changing the beam angle of all the lamps.

One preferred embodiment of the invention uses nine 2,000 watt halogen bulbs as light sources or lamps in the array. A switch is provided for each lamp in the array, so a lesser number of lamps can be used when desired. A lot of heat is generated when all of the lamps are in use, and the housing and the reflectors are structured for the rapid dissipation of this heat.

The primary utility of the invention is for concert lighting, stage lighting, and for the lighting of sets used for motion pictures and television. An important advantage of the invention is that the lighting array, providing as much as 18,000 watts of light, weighs seventy two pounds and is portable. A yoke extends from the housing for attachment to either an overhead support or to a floor based support.

DETAILED DESCRIPTION OF THE INVENTION

Figure 1:
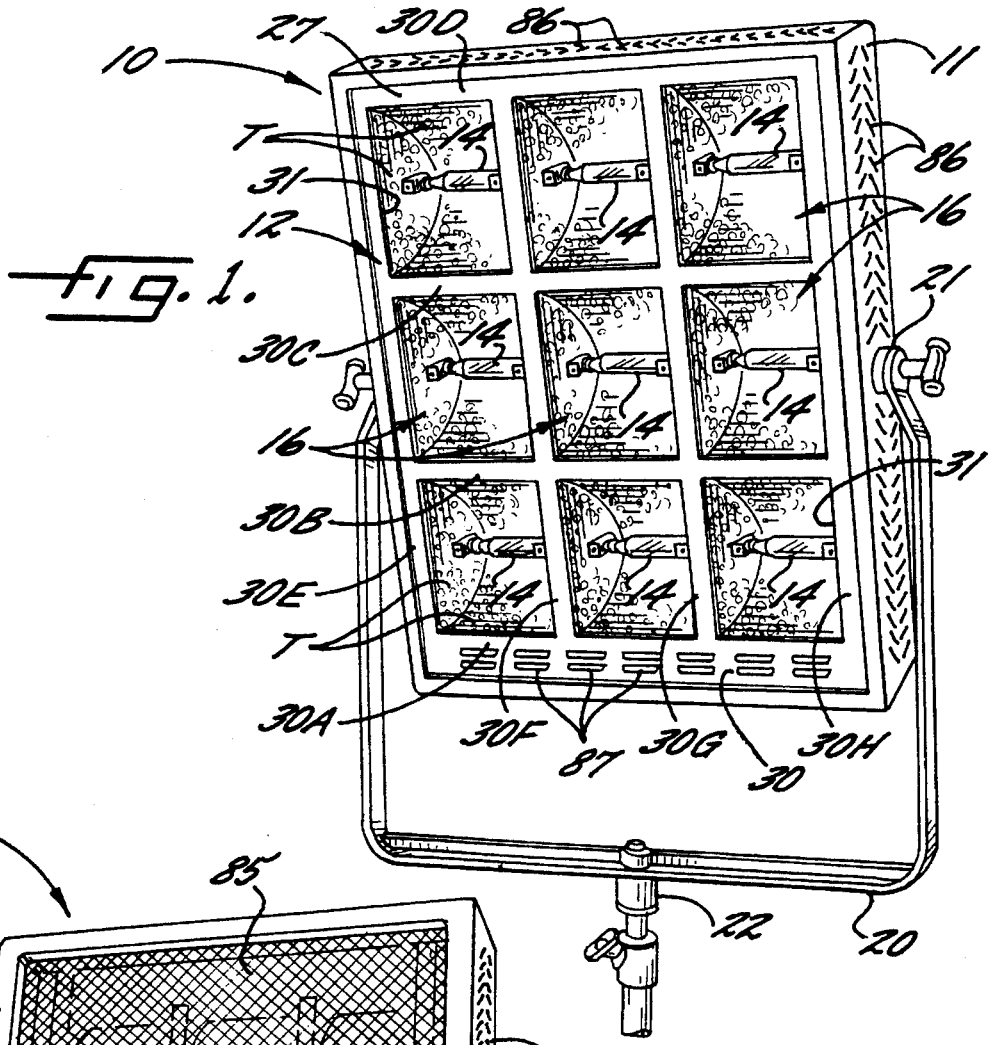
FIG. 1 is a perspective view looking at the front of the lighting array of this invention.

Referring more specifically to the drawings, the invention is preliminarily described in broad terms as a portable array of multiple light sources (lamps), broadly indicated at 10, and comprising a housing 11 enclosing a frame 12 and a platen 13 that is movable with respect to the frame. A plurality of lamps 14 are mounted in sockets 15 that are fixed for movement with the platen 13. Reflectors 16, are mounted on the frame 12 in partially surrounding relation to the lamps 14. A chain drive mechanism, broadly indicated at 17, is mounted on the frame 12 and operably connected to the movable platen 13. The chain drive mechanism is manually operable to move the platen 13 forwardly and rearwardly relative to the frame 12. Movement of the platen 13 causes corresponding movement of the sockets 15 and their lamps 14 relative to the reflectors 16 on the frame 12. The controlled movement of the lamps 14 relative to their reflectors 16 simultaneously adjusts the beam angle of all of the lamps 14 in the array 10.

The ends of a U-shaped yoke 20 are pivotally connected as at 21 to the sides of the housing 11 and the frame 12. A mounting bracket 22 is at the center of the yoke for attachment to a supporting structure. The yoke is pivotable about the housing 11 to selectively position the mounting bracket 22 at either the top or bottom of the array 10.

The Frame

Figure 2:
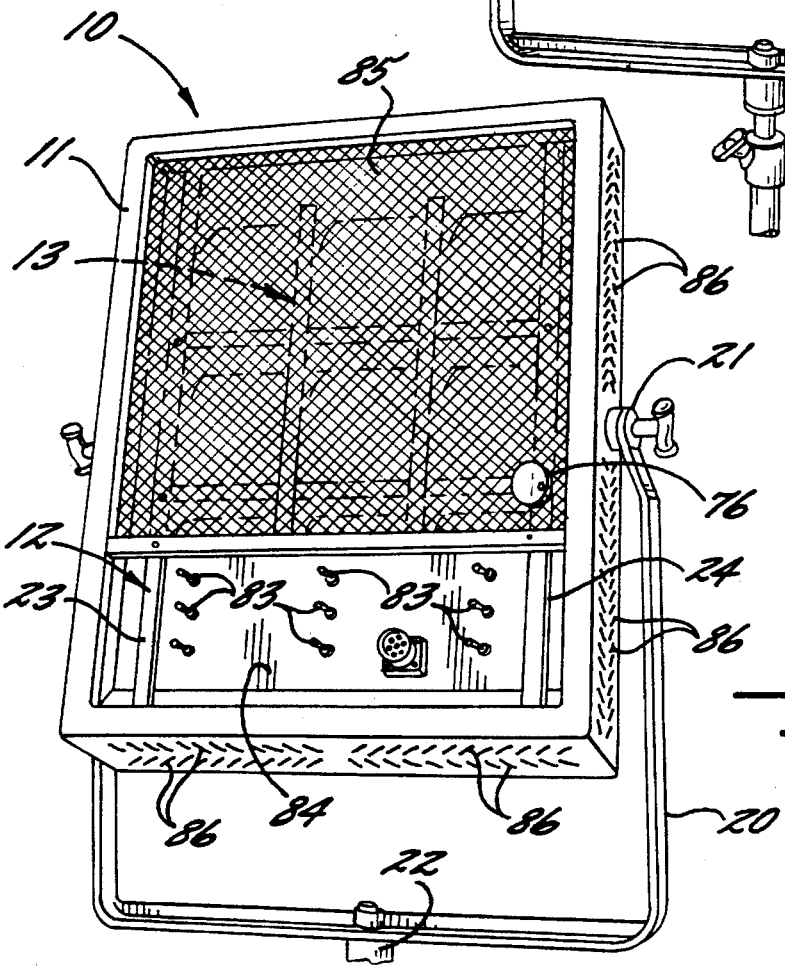
FIG. 2 is a perspective view looking at the rear of the lighting array shown in FIG. 1.

In the illustrated embodiment, the frame 12 comprises a pair of tubular aluminum shafts 23 and 24 extending vertically at the rear of the array in FIG. 2. A pair of angular frame members 25 and 26 (preferably made from aluminum) extend across the rear of the array 10 and join the upper and lower ends of the tubular shafts 23, 24.

The front 27 of the frame 12 is formed from a sheet of aluminum 30 which is preferably one tenth (0.1) of an inch thick. The sheet of aluminum 30 is shaped to form horizontal frame members 30A, 30B, 30C, and 30D fixed in vertically spaced relation to each other and joined by horizontally spaced vertical frame members 30E, 3OF, 30G, and 3OH. Reinforcing bars 28 and 29 are welded behind the horizontal frame members 30B and 30C, respectively. Each of the frame members, 30A–30H, has a generally U-shaped cross-sectional configuration, and they collectively define rectangular openings 31 (FIGS. 4 and 5) between the frame members for reception of the reflectors 16.

The front 27 of the frame is joined to the tubular shafts 23 and 24 at the rear of the frame by side frame members 32 and 33.

The Reflectors

In the illustrated embodiment, there are nine rectangular openings 31 to accomodate nine lamps 14. The front of each opening 31 is substanially covered by one of the reflectors 16. Each reflector is made from three portions 16A, 16B, and 16C that are deliberately spaced from each other to provide outlets for the escape of heat generated by the lamps within the reflectors.

The forward ends of the curved portion 16A of the reflectors 16 are fastened by screws 34 to two of the horizontal frame members 30A, 30B, 30C, and 30D that are proximate to respective reflectors. The screws 34 attach the ends of the curved portions 16A to one leg of the substantially U-shaped horizontal frame members (FIGS. 4 and 5).

Figure 4:
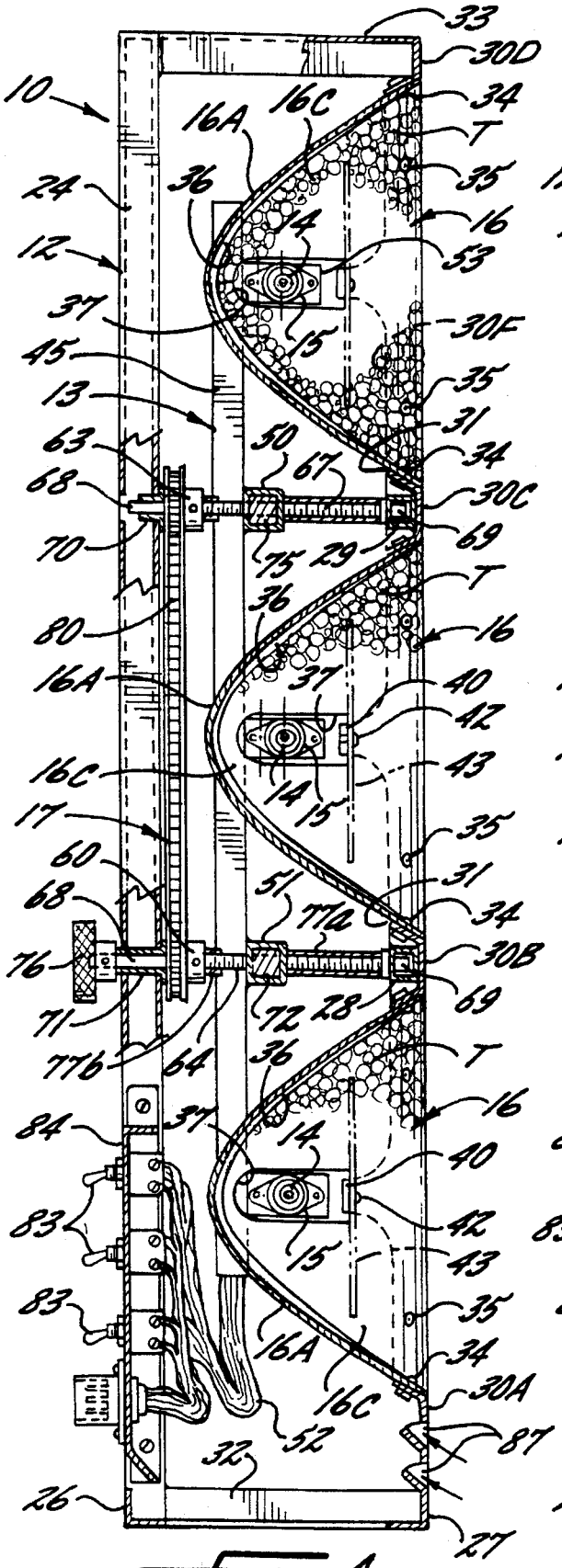
FIG. 4 is a sectional view taken substantially along the line 4—4 in FIG. 3.
Figure 5:
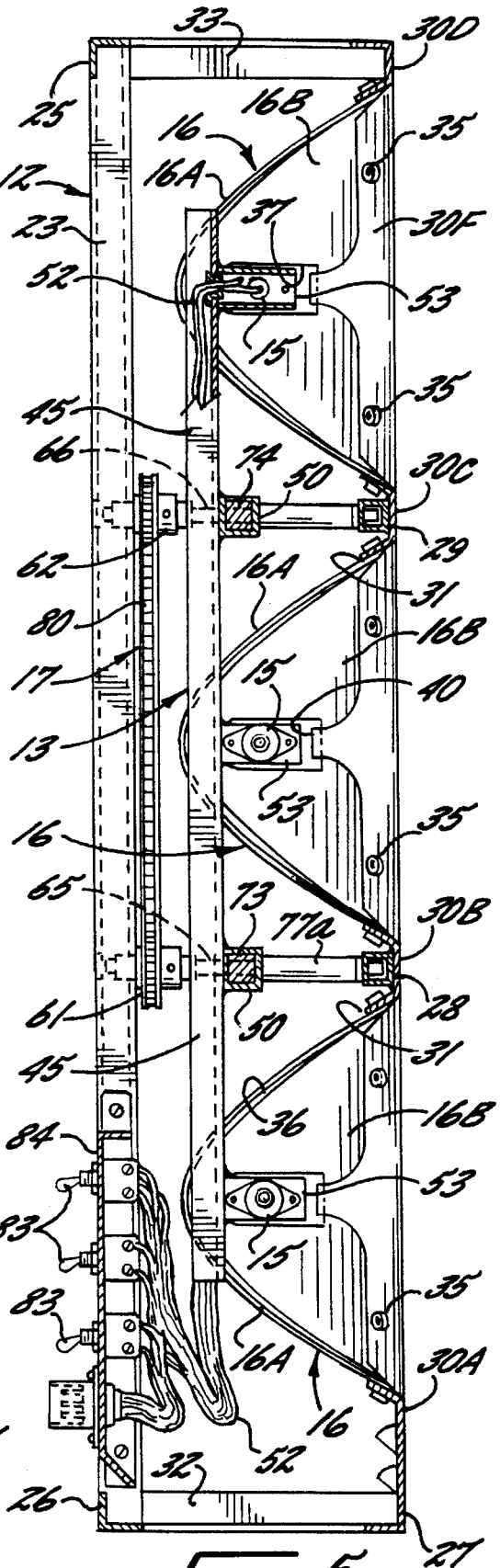
FIG. 5 is a sectional view taken substantially along the line 5—5 in FIG. 3.

The forward end of each of the flat sides 16B and 16C of each reflector 16 is fastened by screws 35 to the vertical frame member (30E, 3OF, 30G, or 3OH) that is proximate to that side of the reflector (FIGS. 4 and 5). The side portions 16B and 16C are spaced forwardly from their respective curved portion 16A in the reflectors 16 to provide outlets 36 for the heat generated by the lamps 14.

Figure 3:
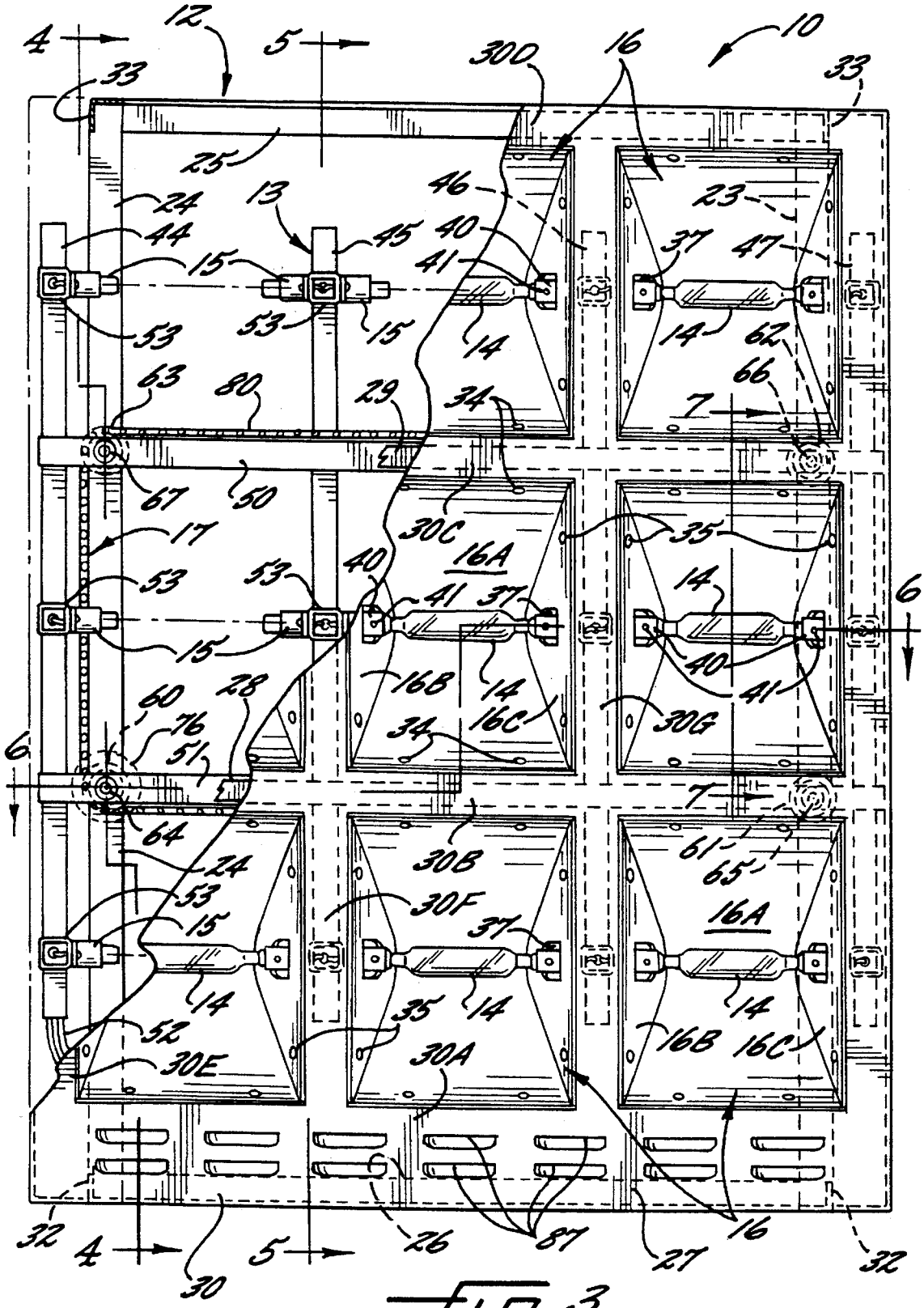
FIG. 3 is a front view of the lighting array, with parts broken away to show portions of the platen and the chain drive.

Each side portion 16B and 16C of the reflectors 16 has a horizontally extending slot 37 to receive one of the sockets 15 fastened to the movable platen 13. The slots begin close to the inner ends of the side portions 16B and 16C and extend forwardly about two and a half inches. The forward end of each slot 37 is penetrated by a tab 40 extending inwardly in a horizontal plane from one of the vertical frame members 30E, 3OF, 30G, or 30H (FIGS. 3, 4, and 5). Each tab 40 has a threaded opening 41 (FIG. 3) to receive a screw 42 for attaching a safety glass 43 in front of the lamp 14 (FIG. 4).

The entire surface of each portion of the reflectors 16 is textured, as indicated at T in FIGS. 1 and 4, to enhance the quality of the light beam generated by the array.

The Novable Platen

The platen 13 comprises four horizontally spaced vertically extending frame members 44, 45, 46, and 47 (FIGS. 3 and 6) and two vertically spaced horizontally extending frame members 50 and 51 (FIG. 3) joined to each of the four vertically extending frame members 44, 45, 46, and 47. The vertically extending frame members 44, 45, 46, and 47 are preferably of U-shaped cross-sectional configuration to provide convenient conduits for the wiring 52 to the sockets 15 and lamps 14.

Abutments 53 extend forwardly from the four vertical frame members 44, 45, 46, and 47 in registry with the slots 37 in each of the reflectors 16. The sockets 15 are attached to the abutments 53 and extend through the slots into their operable positions within the reflectors 16.

The Chain Drive Mechanism

The chain drive mechanism 17 comprises sprocket wheels 60, 61, 62, and 63 rotatable with acme threaded shafts 64, 65, 66, and 67, respectively. Corresponding ends 68 of the threaded shafts ape journaled in brass bearings 70 and 71 mounted in the tubular aluminum shafts 23, 24 at the rear of the array 10, with the shafts 64 and 65 threadably engaging and extending forwardly through respective brass bearings 72 and 73 mounted in the lower horizontal frame member 51 of the platen 13. The threaded shafts 66 and 67 similarly engage and extend forwardly through respective brass bearings 74 and 75 in the upper horizontal frame member 50 of the movable platen 13. The other ends 69 of the threaded shafts 64, 65, 66, and 67 are journaled in brass bearings mounted in the reinforcing bars 29, 29 at the front of the array. Brass bearings are used because of their lubricity. The end 68 of the threaded shaft 64 extends rearwardly beyond the frame member 24 and threadably receives a handle 76 (FIGS. 4 and 5). Plastic spacers **77*a* and 77*b* loosely surround the shafts 64, 65, 66, and 67 between the horizontal frame members 50 and 51 of the platen and the reinforcing bars 28 and 29 on the frame at the front of the array 10**.

A drive chain 80 is trained around the sprockets 60, 61, 62, and 63 and is responsive to manual rotation of the handle 76 to simultaneously impart corresponding rotation to the sprockets and their respective threaded shafts 64, 65, 66, and 67. The brass bearing blocks 72–75, 25 which are fixed against rotation within the horizontal frame members 50, 51 of the movable platen 13, are fitted with acme threads corresponding to the threaded shafts 64–67 whereby rotation of the shafts 64 in either direction imparts axial movement to the platen 13. If the handle 76 is rotated in the clockwise direction as viewed in FIG. 6 the platen moves rearwardly, and it moves forwardly if the handle 76 is rotated in the counterclockwise direction.

Figures 6, 7A, 7B:
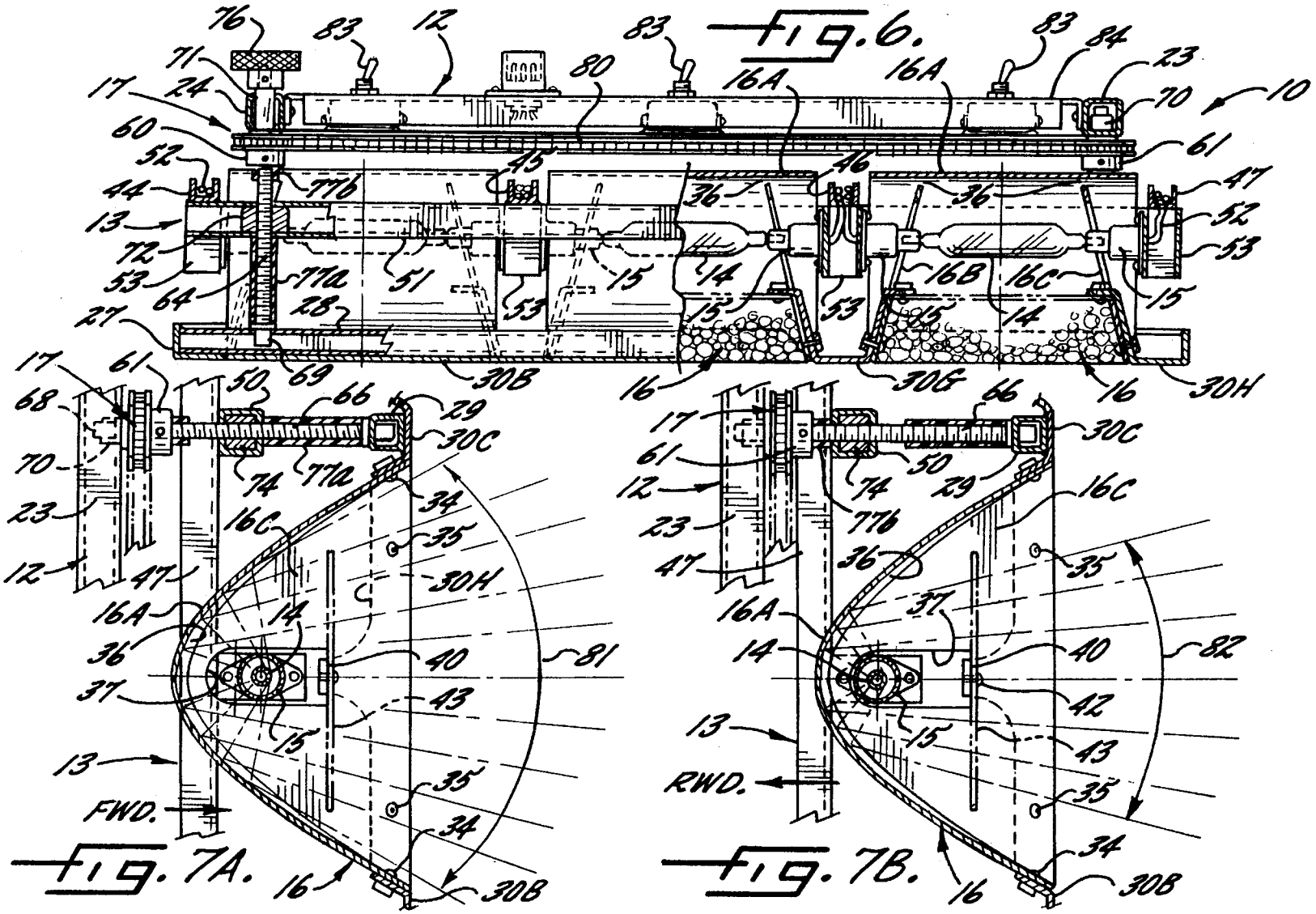
FIG. 6 is a sectional view taken substantially along the line 6—6 in FIG. 3.
FIG. 7A is a sectional view taken substantially along the line 7—7 in FIG. 3, illustrating the relative positions of a lamp and its reflector for the projection of a flood beam.
FIG. 7B is a sectional view taken substantially along the line 7—7 in FIG. 3, illustrating the relative positions of a lamp and its reflector for the projection of a spot beam.
Figure 8:
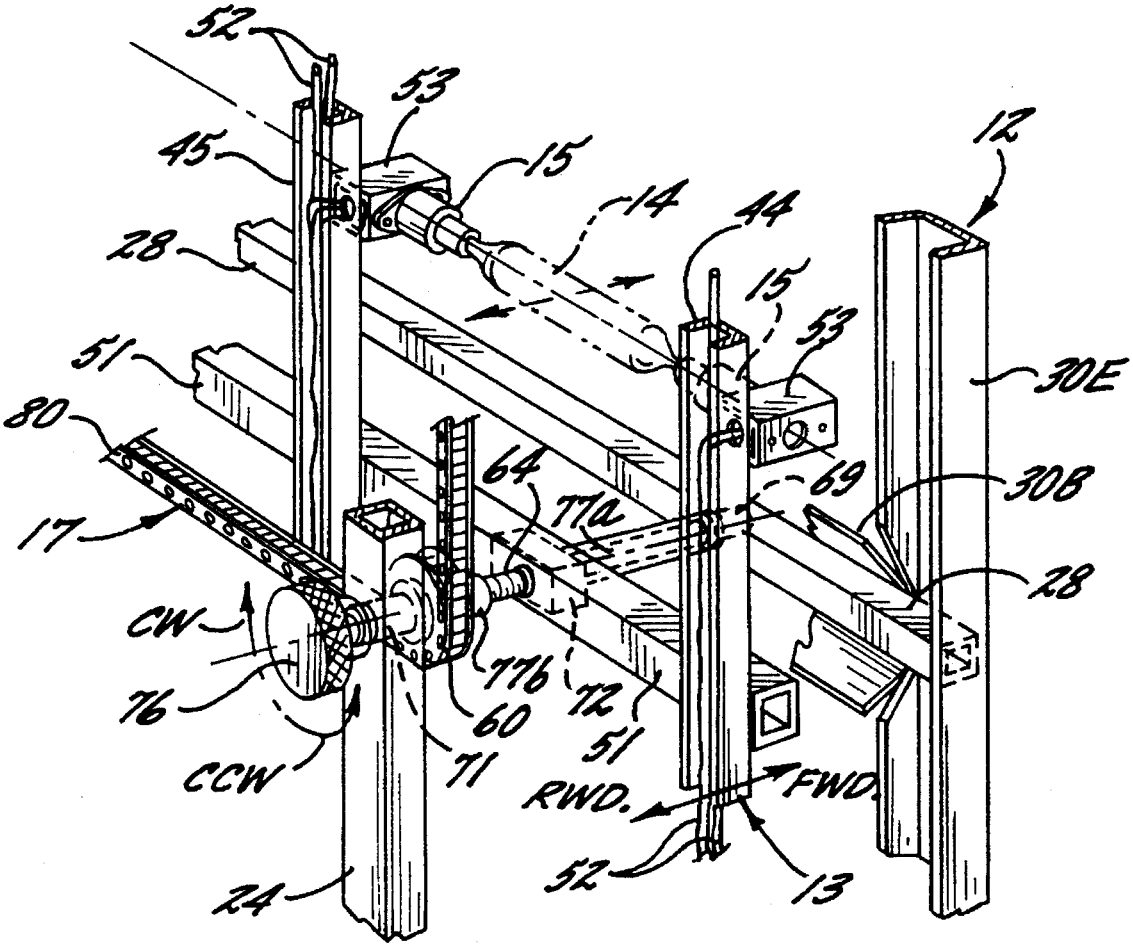
FIG. 8 is an enlarged perspective view, with parts broken away, of a portion of the frame, a portion of the platen and a portion of the chain drive mechanism, illustrating the interaction of these elements for simultaneously adjusting the beam angle of all of the lamps in the array.

FIGS. 7A and 7B illustrate the effect that the movement of the platen 13 forwardly or rearwardly has on the sockets and lamps within the slots in the reflectors. Although only one lamp 14 is shown in FIGS. 7A and 7B, and only the movement of that one lamp is described in discussing the illustration of one of FIGS. 7A and 7B, it is to be understood that the illustration and discussion is applicable to all of the lamps in the array because all of the lamps in the array move simultaneously as the handle 76 and drive mechanism 17 are rotated.

FIG. 7A shows the position of the socket 15 and lamp 14 within the slot 37 after the hand wheel 76 has been fully rotated in a counterclockwise direction and the platen 13 is seated against the forward spacer 77*a*. The lamp 14 is at its greatest distance from the curved inner end of reflector portion 16A, causing the beam of light emanating from the lamp 14 to be focused to provide a wide or flood beam of light, indicated by the curved arrow 81.

FIG. 7B shows the position of the socket 15 and lamp 14 within the slot 37 after the hand wheel 76 has been fully rotated in a clockwise direction and the platen 13 is seated against the rear spacer 77*b*. The lamp 14 is drawn to its closest position relative to the curved inner end of reflector portion 16A. Consequently, the beam of light emanating from the lamp 14 is focused by the lamp and2 a narrow or spot beam, as indicated by the curved arrow 82.

The Lamps and Ventilation

The light source or lamp 14 in the illustrated embodiment is a 2,000 watt halogen tube, fitting into sockets 15 at the ends of the tub2e. The nine 2,000 watt tubes provide 18,000 watts for lighting. When the nine lamps are in use they produce more light than is needed in some instances for adequate stage lighting, or the like.

A separate switch 83 is provided for each lamp in the electric circuit that services the array of lamps. The switches 83 are located in a wiring panel 84 at the rear of the array (FIG. 2). The array may be used with only the desired number of lamps by activating switches for only those lamps that are selected for use.

The amount of heat generated in use of the array varies with the number of lamps in use. So much heat is generated when all nine lamps are used that it is necessary to dissipate the heat into the atmosphere quickly in order to prevent an undesirable buildup of heat with possible damage to the equipment and personnel. The vents 36 in the reflectors 16 are helpful but the heat that passes through those vents must be released to the atmosphere.

Referring to FIGS. 1 and 2, the housing 11 extends around the top, bottom, both sides, and the rear of the array, but not the front. The rear of the housing is foraminated screen 85, except for the wiring panel 84. The sides, top, and bottom of the housing 11 are foraminated with V-shaped vents 86, and the front of the housing has a plurality of relatively larger vents 87.

In practice, when all nine of the 2,000 watt halogen tubes are used, the resulting heat creates a draft that draws atmospheric air into the housing through the vents 87 in the lower front of the housing and through the vents 86 in the bottom of the housing. The air thus drawn into the housing is expelled from the housing through the screen 85 at the rear and through the vents 86 in the top and sides of the housing, carrying away much of the heat generated by the lamps 14.

Conclusion

There is thus provided a portable array of multiple light sources weighing seventy two pounds, yet capable of providing a light source of as much as 18,000 watts. The beam angle of all of the light sources in the array can be quickly and easily simultaneously adjusted between a flood beam and a spot beam, which is desirable for use in stage lighting, concert lighting, and lighting for the filming of motion pictures and television. The ease with which the array can be moved to different positions and supported from above or below is another advantage of the array for theatrical purposes.

Although specific terms have been used in describing the invention, they have been used in a descriptive and generic sense only and not the purpose of limitation. The scope of the invention is to be determined from the appended claims, when read with consideration of the specification and the applicable prior art,

I claim:

1. In an array of lamps having a plurality of light sources, each light source having a lamp, a socket, a reflector and means for connecting the light sources to a source of electrical energy, the combination of:

(a) a frame having an opening for each reflector;

(b) means for attaching the reflectors in the openings in the frame;

(c) each of the reflectors having slots;

(d) a movable platen;

(e) all of the sockets and lamps being mounted on the platen with at least one socket and lamp extending through at least one slot in each reflector.

(f) a chain drive assembly;

(g) means for connecting the chain drive assembly to the frame and to the movable platen;

(h) means for threadably connecting the chain drive assembly to the platen; and (i) means for rotating the threadable connection between the chain drive assembly and the platen to move the platen relative to the frame.

2. Apparatus for simultaneously adjusting a beam angle of a plurality of lamps in an array of lamps having a plurality of light sources, each light source including a lamp, a socket and a reflector and the array having a frame and means for connecting the light sources to a source of electrical energy, wherein the improvement comprises:

(a) means for mounting all of the reflectors on the frame;

(b) a movable platen;

(c) means for mounting all of the sockets and all of the lamps on the platen with the socket and the lamp within each of the reflectors on the frame;

(d) means for moving the platen, sockets and lamps relative to the frame and relative to the reflectors on the frame to simultaneously vary the distance between all of the lamps and their respective reflectors, said means for moving the platen comprising:

(i) a chain drive assembly;

(ii) means for connecting the chain drive assembly to the frame and to the movable platen;

(iii) means for threadably connecting the chain drive assembly to the movable platen; and (iv) means for rotating the threadable connection between the chain drive assembly and the platen to move the platen relative to the frame.

* * * * *